US008301052B2

(12) United States Patent
Sasaki et al.

(10) Patent No.: US 8,301,052 B2
(45) Date of Patent: Oct. 30, 2012

(54) IMAGE FORMING APPARATUS WITH USER CONTACT PREVENTION

(75) Inventors: Keiji Sasaki, Saitama (JP); Takaaki Fukushima, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 373 days.

(21) Appl. No.: 12/632,309

(22) Filed: Dec. 7, 2009

(65) Prior Publication Data

US 2010/0215393 A1 Aug. 26, 2010

(30) Foreign Application Priority Data

Feb. 25, 2009 (JP) ..... 2009-042286
Feb. 25, 2009 (JP) ..... 2009-042287

(51) Int. Cl.
*G03G 15/00* (2006.01)

(52) U.S. Cl. ..... 399/88; 399/92; 399/98

(58) Field of Classification Search ..... 399/88, 399/91–93, 98, 102, 103, 107–116
See application file for complete search history.

(56) References Cited

U.S. PATENT DOCUMENTS

| | | | | |
|---|---|---|---|---|
| 2004/0126150 | A1 | 7/2004 | Noguchi et al. | |
| 2004/0131378 | A1 | 7/2004 | Hattori et al. | 399/90 |
| 2004/0131380 | A1 | 7/2004 | Kuma et al. | 399/90 |
| 2005/0169653 | A1 | 8/2005 | Noguchi et al. | |
| 2005/0169664 | A1* | 8/2005 | Arimitsu et al. | 399/111 |
| 2006/0002738 | A1 | 1/2006 | Kurita | 399/124 |
| 2006/0008288 | A1 | 1/2006 | Kuma et al. | 399/90 |
| 2007/0086807 | A1 | 4/2007 | Kuma et al. | 399/121 |
| 2007/0147872 | A1 | 6/2007 | Nakano | 399/88 |

FOREIGN PATENT DOCUMENTS

| | | | |
|---|---|---|---|
| JP | 2000-132060 | | 5/2000 |
| JP | 2002-31924 | A | 1/2002 |
| JP | 2003-202728 | | 7/2003 |
| JP | 2004-151389 | A | 5/2004 |
| JP | 2004-157463 | A | 6/2004 |
| JP | 2005-31122 | A | 2/2005 |
| JP | 2005-309278 | A | 11/2005 |
| JP | 2005-351938 | A | 12/2005 |
| JP | 2006-48004 | A | 2/2006 |
| JP | 2006-113482 | A | 4/2006 |
| JP | 2006-139068 | | 6/2006 |
| JP | 2006-154134 | | 6/2006 |
| JP | 3850774 | | 11/2006 |
| JP | 2007-133433 | A | 5/2007 |
| JP | 2007-171773 | A | 7/2007 |

* cited by examiner

*Primary Examiner* — Hoan Tran
(74) *Attorney, Agent, or Firm* — Sughrue Mion, PLLC

(57) ABSTRACT

An image forming apparatus includes plural image holders that hold an image; plural development devices that produce an image on the plural image holders; an intermediate transfer body supported by plural support members; plural first transfer devices that transfer images that are present on the plural image holders to the intermediate transfer body; a second transfer device that transfers a composite image from the intermediate transfer body onto a recording medium; a fixing device that fixes the composite image onto the recording medium; an ejection device that ejects the recording medium having the composite image transferred thereto out of the image forming apparatus main body; and a recording medium stacking part where ejected recording media are stacked.

20 Claims, 13 Drawing Sheets

IMAGE FORMING APPARATUS WITH USER CONTACT PREVENTION

CROSS-REFERENCE TO RELATED APPLICATIONS

This application is based on and claims priority under 35 USC 119 from Japanese Patent Application Nos. 2009-042286 filed Feb. 25, 2009 and 2009-042287 filed Feb. 25, 2009.

BACKGROUND

1. Technical Field

The present invention relates to image forming apparatus.

2. Summary

According to an aspect of the invention, there is provided an image forming apparatus including plural image holders that hold an image respectively; plural development devices that produce an image on the plural image holders respectively; an intermediate transfer body supported by plural support members; plural first transfer devices that respectively transfer images which are respectively present on the plural image holders in turn and overlayingly onto the intermediate transfer body; a second transfer device that transfers a composite transferred image from the intermediate transfer body onto a recording medium; a fixing device that fixes the composite image onto the recording medium by applying heat and pressure to the recording medium having the composite image transferred thereto; an ejection device that ejects the recording medium having the composite image fixed thereto out of the image forming apparatus main body; and a recoding medium stacking part where ejected recording media are stacked, the plural image holders being arranged along an under side of the intermediate transfer body, the apparatus further including a first power supply unit located beneath the plural image holders and a second power supply unit located above the intermediate transfer body.

BRIEF DESCRIPTION OF THE DRAWINGS

Exemplary embodiments of the present invention will be described in detail based on the following figures, wherein:

FIGS. 5A and 5B illustrate movement of a shutter member included in the photoreceptor unit shown in FIG. 4, wherein FIG. 5A is a cross-sectional view in which the shutter member lies in a second position and FIG. 5B is a cross-sectional view in which the shutter member lies in a first position;

DETAILED DESCRIPTION

Exemplary embodiments of the present invention will now be described with reference to the drawings.

Figure 1:
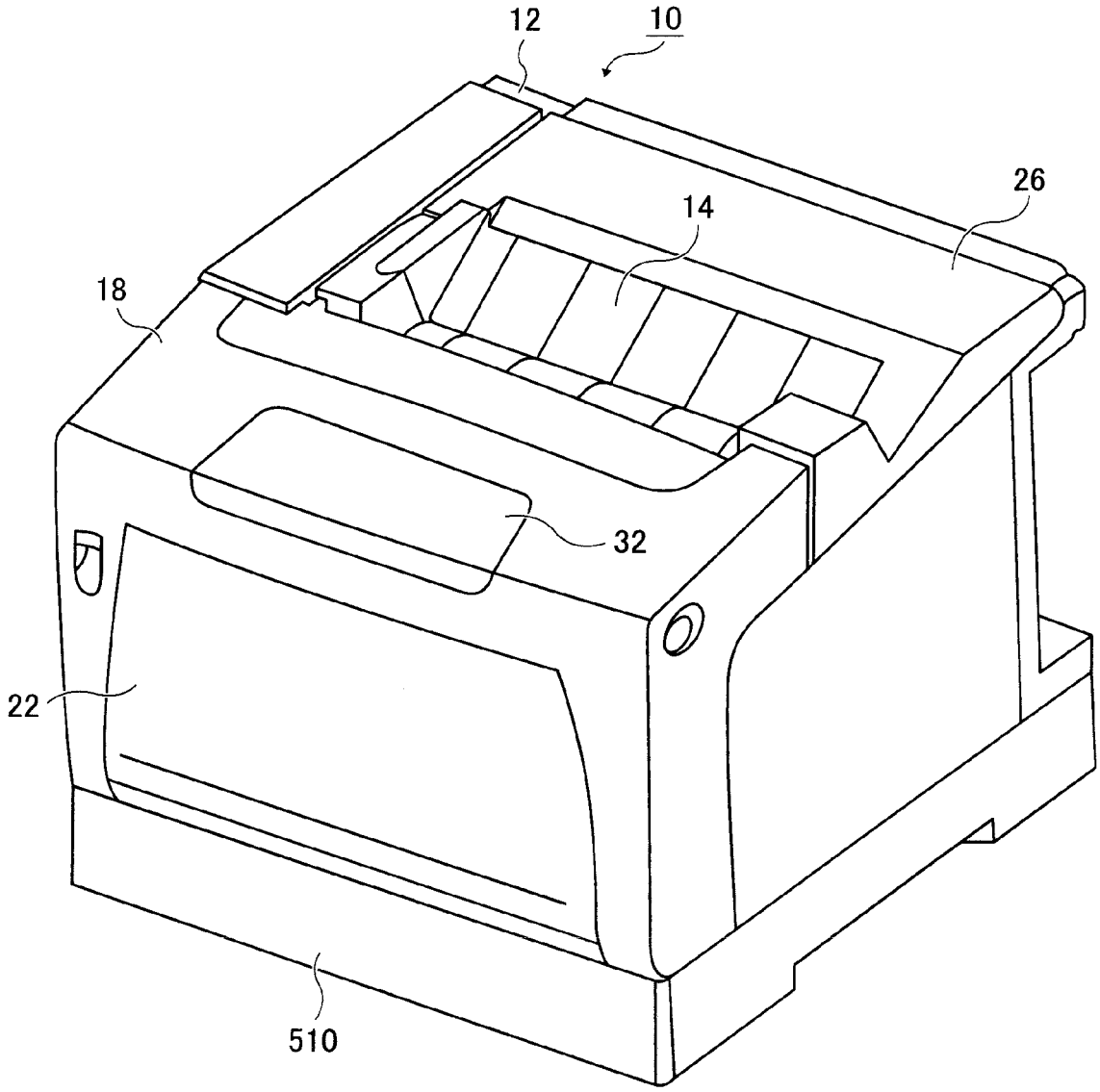
FIG. 1 is a perspective view showing an image forming apparatus in accordance with a first exemplary embodiment of the invention.
Figure 2:
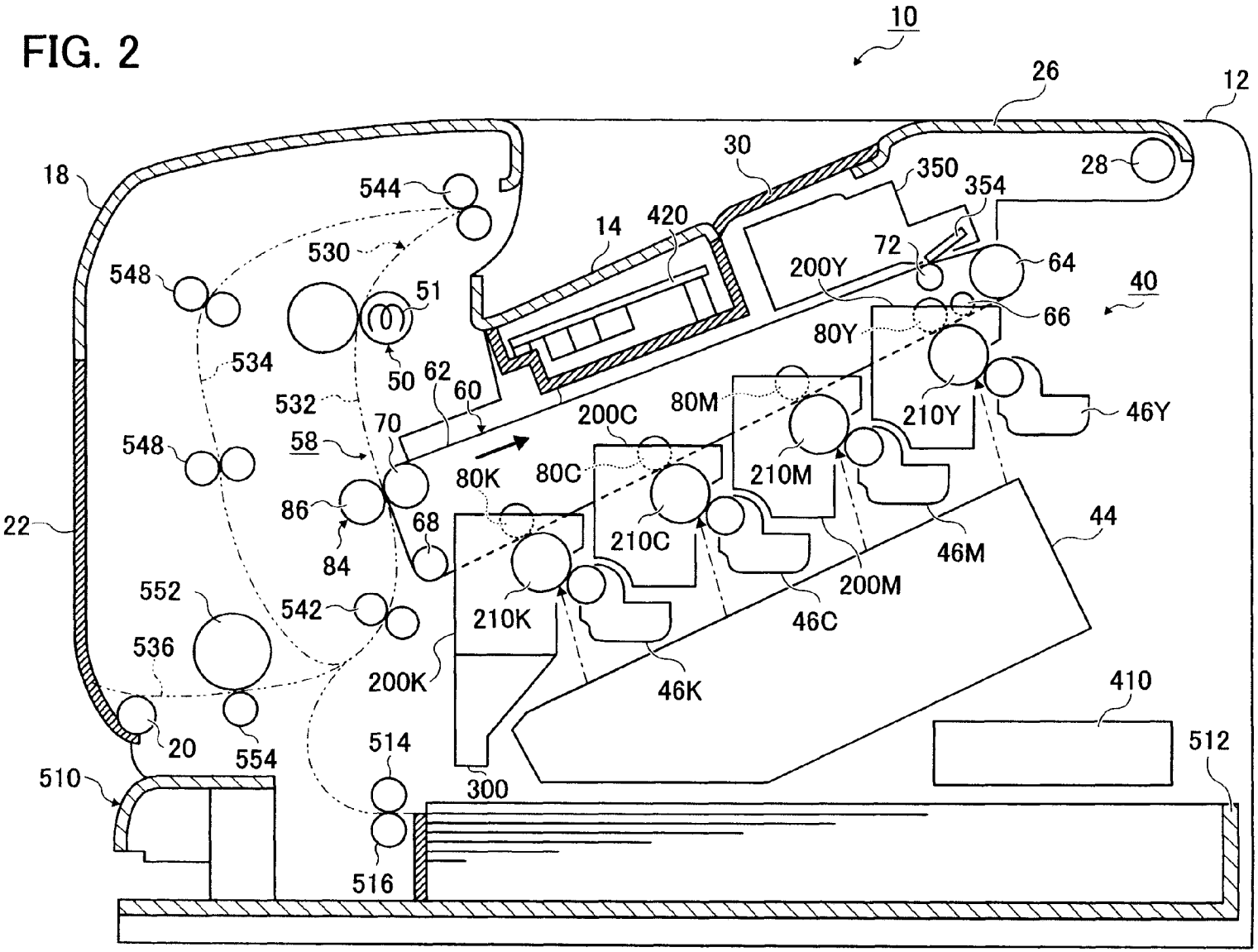
FIG. 2 is a cross-sectional view of the image forming apparatus shown in FIG. 1.

An image forming apparatus 10 in accordance with a first exemplary embodiment of the invention is shown in FIG. 1 and FIG. 2. As can be seen in FIG. 1 and FIG. 2, the image forming apparatus 10 has an image forming apparatus main body 12.

A front opening/closing part 18 is hinged to the image forming apparatus main body 12 with hinges 20, so that it can be opened and closed with respect to the apparatus main body 12. Also, a main opening/closing part 26 is hinged to the image forming apparatus main body 12 with hinges 28, so that it can be opened and closed with respect to the apparatus main body 12. An operator panel 32 is mounted in the front of the image forming apparatus main body 12.

An area of the upper surface of the image forming apparatus 10, for example, the upper surface of the main opening/closing part 26 is used as a paper output part 14 to which paper having an image formed thereon is ejected.

An opening/closing part 22 for supply is mounted in the front opening/closing part 18, so that the part 22 can be opened and closed. The opening/closing part 22 for supply is usually closed with respect to the front opening/closing part 18, as shown in FIG. 1 and FIG. 2. The opening/closing part 22 for supply is opened with respect to the front opening/closing part 18, when the user wants to use sheets different from ones stored in a sheet feeder 510 which will be described later.

The main opening/closing part 26 is usually closed with respect to the image forming apparatus main body 12. The main opening/closing part 26 is opened for installing or removing at least one of photoreceptor units 200Y, 200M, 200C, 200B which will be described later in/from the image forming apparatus main body 12. In order to prevent that a support roller 70, an intermediate transfer belt 62, etc., which will be described later, assembled in the main opening/closing part 26 interfere with the front opening/closing part 18, the front opening/closing part 18 should be opened with respect to the image forming apparatus main body 12 before opening the main opening/closing part 26.

When closing the front opening/closing part 18 with respect to the image forming apparatus main body 12, the main opening/closing part 26 should be closed with respect to the image forming apparatus main body 12 before closing the front opening/closing part 18. The upper surface of the main opening/closing part 26 is used as the paper output part to which sheets having an image formed thereon are ejected.

A secondary opening/closing part 30 is assembled in the main opening/closing part 26, so that it can be opened and closed with respect to the main opening/closing part 26. The secondary opening/closing part 30 can be opened and closed independently of the main opening/closing part 26; it can be opened while the main opening/closing part 26 is closed with respect to the image forming apparatus main body 12. The secondary opening/closing part 30 is opened for installing or removing the whole or a part of a developer remover 350 which will be described later in/from the image forming apparatus main body 12.

The operator panel 32 includes, for example, a numeric keypad which is used to enter the number of sheets which are subjected to image formation thereon, a start button which is pressed to start an image forming operation, and others.

Inside the image forming apparatus main body 12, an image forming part 40 is provided that forms an image on a sheet. The image forming part 40 includes, for example, four photoreceptor units 200Y, 200M, 200C, 200K.

The photoreceptor units 200Y, 200M, 200C, 200K are respectively used as image forming structures and, respectively, have photoreceptor drums 210Y, 210M, 210C, 210K, each of which can be separately installed and removed in/from the image forming apparatus main body 12. The photoreceptor units 200Y, 200M, 200C, 200K are arranged in the order of a photoreceptor unit 200Y which is the first one, a second unit 200M, a third unit 200C, and the last unit 200K from the rear side (right side in FIG. 2) of the image forming apparatus main body 12. The photoreceptor units 200Y, 200M, 200C, 200K will be detailed later.

The photoreceptor drums 210Y, 210M, 210C, 210K are used as image holders that hold an image respectively.

The image forming part 40 also includes an optical projection device 44 which serves as a latent image forming device. The optical projection device 44 irradiates each of the photoreceptor drums 210Y, 210M, 210C, 210K with light and forms a latent image on the surface of each of the photoreceptor drums 210Y, 210M, 210C, 210K.

The image forming part 40 also includes development devices 46Y, 46M, 46C, 46K. The development device 46Y develops a latent image formed on the photoreceptor drum 210Y with a yellow toner stored therein. The development device 46M develops a latent image formed on the photoreceptor drum 210M with a magenta toner stored therein. The development device 46C develops a latent image formed on the photoreceptor drum 210C with a cyan toner stored therein. The development device 46K develops a latent image formed on the photoreceptor drum 210K with a black toner stored therein.

The image forming part 40 further includes a transfer device 58. The transfer device 58 includes an intermediate transfer belt unit 60 and a second transfer device 84. The intermediate transfer belt unit 60 includes an intermediate transfer belt 62.

The intermediate transfer belt 62 serves as an intermediate transfer body onto which images (toner images) are transferred from the photoreceptor drums 210Y, 210M, 210C, 210K. The intermediate transfer belt 62 is endless and lays across in a tensioned state on support rollers 64, 66, 68, 70, 72 so that it can rotate in a direction indicated by an arrow in FIG. 2. A driving force from a motor 90 (see FIG. 7) is conveyed to a support roller 70 via a gear 92 (see FIG. 7) which will be described later and, by its turning driven by the driving force from the motor 90, the support roller 70 conveys the driving force to the intermediate transfer belt 62.

The intermediate transfer belt unit 60 also includes first transfer rollers 80Y, 80M, 80C, 80K which are used as a first transfer device. The first transfer rollers 80Y, 80M, 80C, 80K transfer yellow, magenta, cyan, and black toner images respectively formed on the photoreceptor drums 210Y, 210M, 210C, 210K to the intermediate transfer belt 62. Additional description will be provided later for the intermediate transfer belt unit 60.

The second transfer device 84 includes a second transfer roller 86. The second transfer roller 86 further transfers the yellow, magenta, cyan, and black toner images transferred to the intermediate transfer belt 62 onto a sheet.

The transfer device 58 includes a developer remover 350. The developer remover 350 includes a scraping member 354. A part of the developer remover 350 can be installed and removed in/from the image forming apparatus main body 12 through an opening provided by opening the secondary opening/closing part 30. The developer remover 350 will be detailed later.

Among the members constituting the transfer device 58, the intermediate transfer belt unit 60 and the developer remover 350 are assembled in the main opening/closing part 26. Among the components of the transfer device 58, the second transfer roller 86 is fixed to the image forming apparatus main body 12. Moreover, the intermediate transfer belt 62 is disposed aslant such that its one end portion being in contact with the support roller 70, adjacent to the second transfer device 84, is positioned lower in the direction of gravitational force than its opposite end portion being in contact with the support roller 64.

Inside the image forming apparatus main body 12, furthermore, a fixing device 50 is provided that fixes a composite toner image transferred to a sheet by the second transfer roller 86 onto the sheet. The fixing device 50 includes a heater 51. The fixing device 50 fixes the composite developer image onto the sheet by pressing the developer image onto the sheet, while applying heat generated by the heater 51.

Inside the image forming apparatus main body 12, a waste toner receiver 300 is also provided. Deteriorated waste developer particles expelled from the development devices 46Y, 46M, 46C, 46K are collected into the waste toner receiver 300. The waste toner receiver 300 is, for example, integral with the photoreceptor unit 200K.

Inside the image forming apparatus main body 12, a sheet feeder 510 is installed to feed a sheet to the image forming part 40. The sheet feeder 510 can be pulled out from the front side (left side in FIG. 2) of the image forming apparatus main body 12, so that the sheet feeder 510 will be replenished with sheets after being pulled out of the image forming apparatus main body 12.

The sheet feeder 510 has a sheet container 512 which stocks a stack of sheets of, e.g., plain paper. The sheet feeder 510 includes a feed roller 514 which extracts a sheet at the top of the sheet stack stocked in the sheet container 512 and feeds the extracted sheet toward the image forming part 40. The sheet feeder 510 also includes a retard roller 516 to retard sheets which is used to prevent plural sheets clinging together from being fed to the image forming part 40.

Moreover, a transport path 530 that is used to transport a sheet is formed inside the image forming apparatus main body 12. The transport path 530 includes a main transport path 532, a reverse transport path 534, and a sub-transport path 536.

The main transport path 532 is used to transport a sheet fed from the sheet feeder 510 to the image forming part 40 and eject the sheet having an image formed thereon out of the image forming apparatus main body 12. Along the main transport path 532, the above-mentioned feed roller 514 and retard roller 516, registration rollers 542, the above-mentioned second transfer roller 86, the above-mentioned fixing device 50, and eject rollers 544 are disposed in the mentioned order from upstream in a direction in which a sheet is transported.

The registration rollers 542 temporarily stop the forward edge of a sheet fed from the sheet feeder 510 and transport the sheet toward the second transfer roller 86 so that the sheet will enter the rollers, namely, the second transfer roller 86 and the support roller 70, in time with timing when the toner images of each color have been transferred to the intermediate transfer belt 62.

The eject rollers 544 eject a sheet having the toners of each color fixed onto it by the fixing device 50 out of the image forming apparatus main body 12.

The reverse transport path 534 is a transport path which is used to turn over and supply again a sheet having a composite toner image fixed onto its one side toward the image forming part 40. Along the reverse transport path 534, for example, two pairs of reverse transport rollers 548 are disposed. In the reverse transport path 534, once the rear edge of a sheet have been nipped between the eject rollers 544, the sheet is supplied again, moved back by reverse rotation of the eject rollers 544, i.e., its rear edge goes ahead, and the supplied sheet is transported by the reverse transport rollers 548 to a position upstream of the registration rollers 542.

The sub-transport path 536 is a transport path to supply a different sheet from the sheets stored in the sheet feeder 510 to the image forming part 40. With the opening/closing part 22 for supply being open, a sheet is supplied to the sub-transport path 536 from the front side of the image forming apparatus main body 12. Along the sub-transport path 536, a transport roller 522 and a retard roller 554 are provided. The transport roller 522 transports a sheet supplied to the sub-transport path 536 toward the image forming part 40. The retard roller 554 is used to retard sheets supplied to the sub-transport path 536 and prevent plural sheets clinging together from being transported to the image forming part 40.

Inside the image forming apparatus main body 12, a first power supply unit 410 is further provided. The first power supply unit 410 includes a high-voltage power supply circuit and feeds power to, for example, the development devices 46Y, 46M, 46C, 46K.

In the image forming apparatus 10, furthermore, a second power supply unit 420 is located above the intermediate transfer belt 62. The second power supply unit 420 is installed in the main opening/closing part 26 and feeds power to, for example, the first transfer rollers 80Y, 80M, 80C, 80K, among others.

As can be seen in FIG. 2, in the image forming apparatus 10, the intermediate transfer belt 62 is located over the photoreceptor drums 210Y, 210M, 210C, 210K. In the image forming apparatus 10, the first power supply unit 410 is located beneath the photoreceptor drums 210Y, 210M, 210C, 210K. Furthermore, in the image forming apparatus 10, the second power supply unit 420 is located above the intermediate transfer belt 62.

Furthermore, in the image forming apparatus 10, the optical projection device 44 is located beneath the photoreceptor drums 210Y, 210M, 210C, 210K and the first power supply unit 410 is located beneath the optical projection device 44. Furthermore, in the image forming apparatus 10, the paper output part 14 is located above the intermediate transfer belt 62 and the second power supply unit 420 is located in a space provided between the intermediate transfer belt 62 and the paper output part 14.

Furthermore, in the image forming apparatus 10, the developer remover 350 and the fixing device 50 are located near outside the opposite long lateral walls of the second power supply unit 420.

Figure 3:
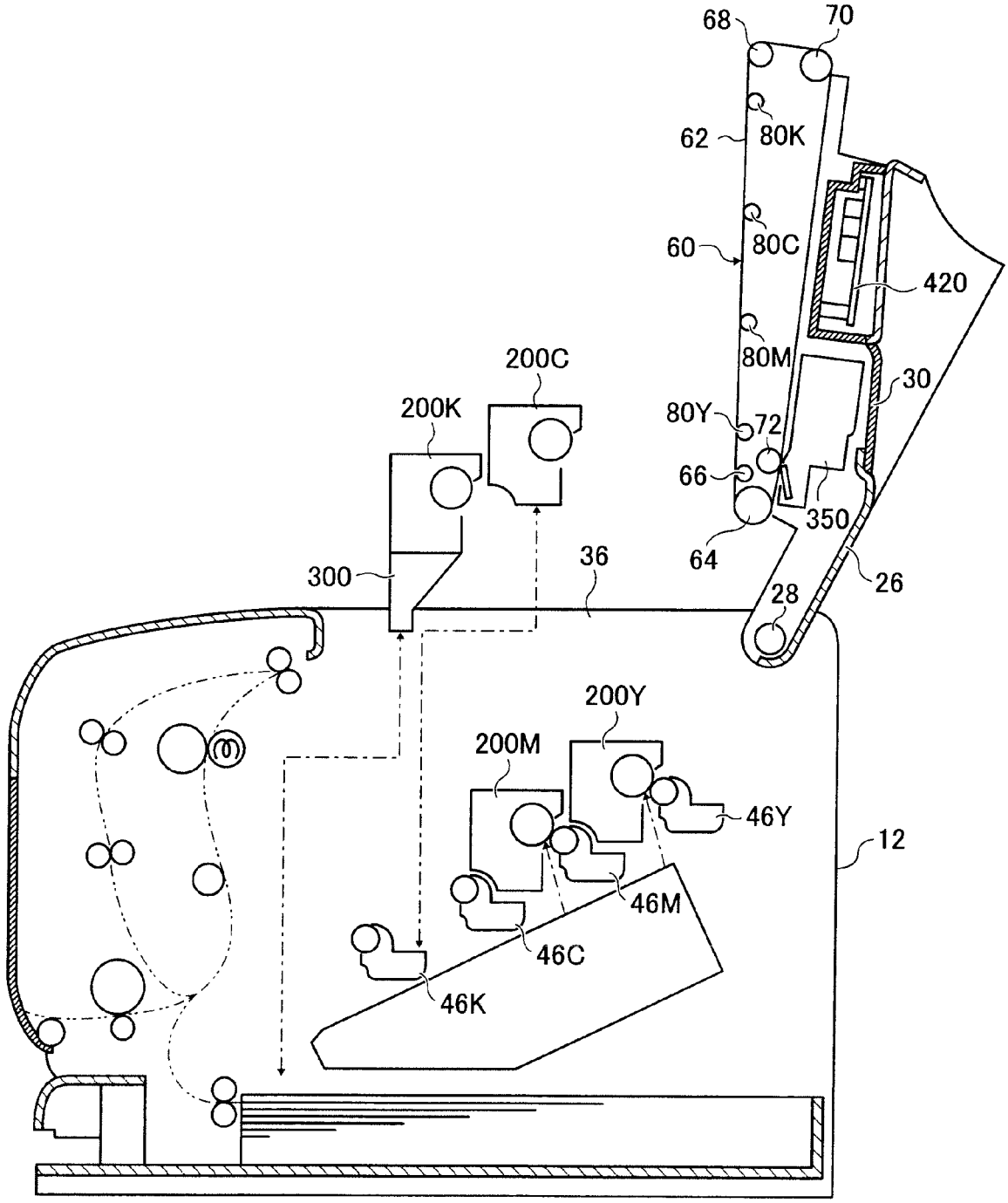
FIG. 3 is a side view of the apparatus, illustrating how a main opening/closing part is opened/closed with respect to the main body of the image forming apparatus shown in FIG. 1 and how photoreceptor units are installed in and removed from the main body.

FIG. 3 illustrates how the main opening/closing part 26 is opened/closed with respect to the image forming apparatus main body 12 and how the photoreceptor units 200 are installed in and removed from the image forming apparatus main body 12.

As shown in FIG. 3, when the main opening/closing part 26 is opened with respect to the image forming apparatus main body 12, the intermediate transfer belt unit 60 and the developer remover 350 in the transfer device 58 as well as the second power supply unit 420 are displaced together with the main opening/closing part 26. That is, the intermediate transfer belt unit 60, the developer remover 350, and the second power supply unit 420 are opened and closed as an assembly in the main opening/closing part 26 with respect to the image forming apparatus main body 12.

When the main opening/closing part 26, the intermediate transfer belt unit 60, the developer remover 350, and the second power supply unit 420 are opened with respect to the image forming apparatus main body 12, an open space 36 is provided in the image forming apparatus main body 12. Through the open space 36, each of the photoreceptor units 200Y, 200M, 200C, 200K is installed in and removed from the image forming apparatus main body 12. The waste toner receiver 300 is integral with the photoreceptor unit 200K, as already mentioned. Therefore, the waste toner receiver 300 is installed and removed integrally with the photoreceptor unit 200K in/from the image forming apparatus main body 12.

Figure 4:
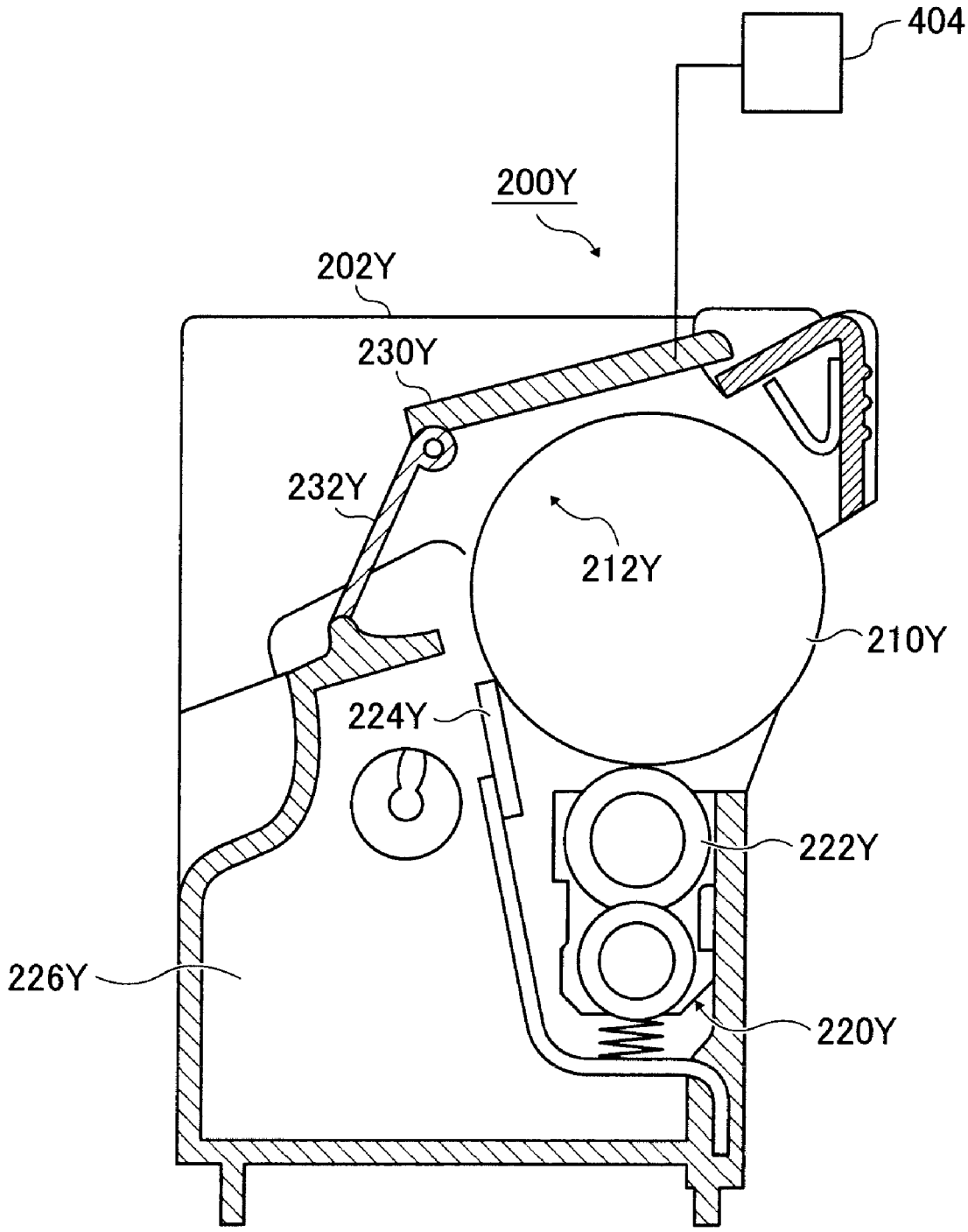
FIG. 4 is a cross-sectional view of a photoreceptor unit employed in the image forming apparatus shown in FIG. 1.

A photoreceptor unit 200Y is shown in FIG. 4. Since the photoreceptor units 200M, 200C, 200K have the same structure as the photoreceptor unit 200Y, though they use developers of different colors, their descriptions are omitted.

As shown in FIG. 4, the photoreceptor unit 200Y has a photoreceptor unit main body 202Y and the above-mentioned photoreceptor drum 210Y is installed in the photoreceptor unit main body 202Y. A part of the photoreceptor drum 210Y is exposed outside the photoreceptor unit main body 202Y as an exposed portion 212Y. The photoreceptor unit main body 202Y serves as a housing in which the photoreceptor drum 210Y is installed with a part of the drum being exposed.

Inside the photoreceptor unit main body 202Y, a charging device 220Y which evenly charges the surface of the photoreceptor drum 210Y is installed. The charging device 220Y includes a charging roller 222Y contacting with the photoreceptor drum 210Y. Onto the surface of the photoreceptor drum 210Y evenly charged by the charging device 220Y evenly, a latent image is projected by the optical projection device 44 (see FIG. 1).

Inside the photoreceptor unit main body 202Y, further, a scraping member 224Y which serves as a cleaning device is installed. The scraping member 224Y scrapes off yellow toner particles remaining on the surface of the photoreceptor drum 210Y after a yellow toner image has been transferred to the intermediate transfer belt 62 by the first transfer roller 80Y (see FIG. 1).

Inside the photoreceptor unit main body 202Y, there is also a waste toner chamber 226Y where yellow toner particles scraped off by the scraping member 224Y from the surface of the photoreceptor drum 210Y are collected.

In the photoreceptor unit main body 202Y, further, a shutter member 230Y is installed via, e.g., a support member 232Y. The shutter member 230Y serves as a moving member. The shutter member 230Y is also connected to a linkage mechanism 404 and the shutter member 230Y is connected via the linkage mechanism 404 to the above-mentioned intermediate transfer belt unit 60.

Figure 5B:
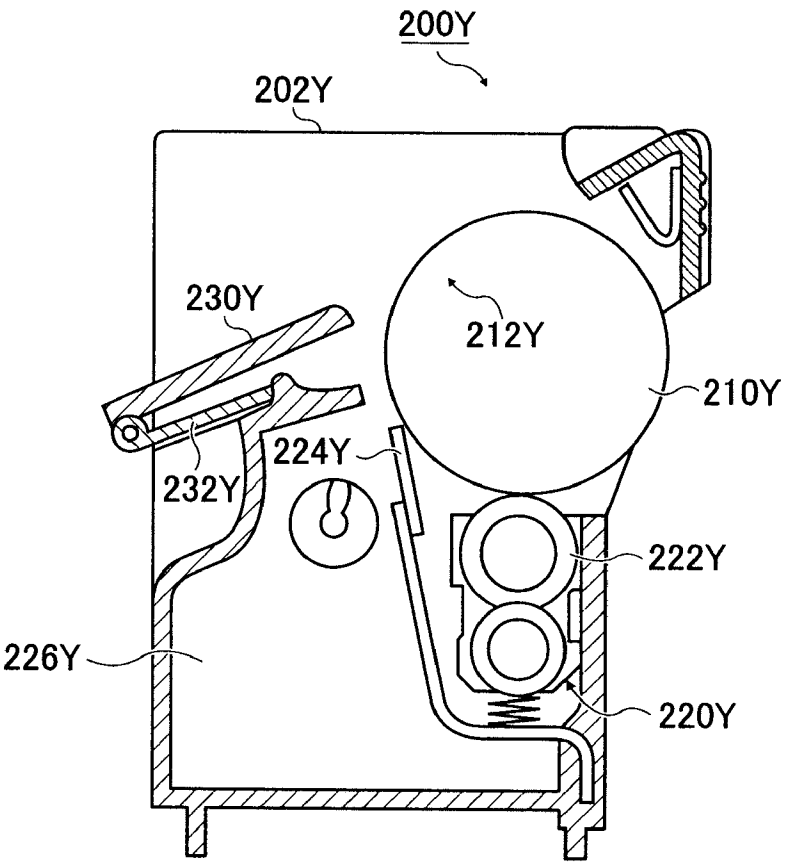
Figure 5A:
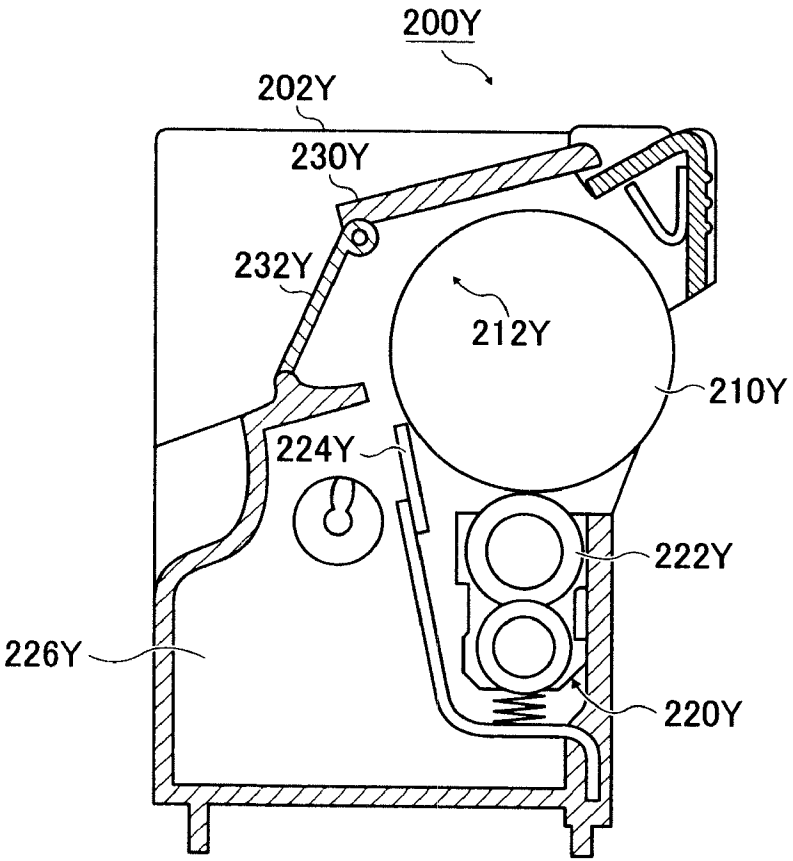

Movement of the shutter member 230Y is illustrated in FIGS. 5A and 5B. The shutter member 230Y moves between a position shown in FIG. 5A which is used as a second position and a position shown in FIG. 5B which is used as a first position.

The second position shown in FIG. 5A is the position in which the shutter member 230Y covers the exposed portion 212Y of photoreceptor drum 210Y (hereinafter referred to as a covering position). The first position shown in FIG. 5B is the position in which the shutter member 230Y leaves the exposed portion 212Y exposed out of the photoreceptor unit main body 202 (hereinafter referred to as an exposure position).

The shutter member 230Y lies in the covering position shown in FIG. 5A in a state where the photoreceptor unit 200Y is removed from the image forming apparatus main body 12. The shutter member 230Y still lies in the covering position shown in FIG. 5A in a state where the photoreceptor unit 200Y is installed in the image forming apparatus main body 12, but the intermediate transfer belt unit 60 is opened with respect to the image forming apparatus main body 12. However, the shutter member 230Y lies in the exposure position shown in FIG. 5B in a state where the photoreceptor unit 200Y is installed in the image forming apparatus main body 12 and the intermediate transfer belt unit 60 is closed with respect to the image forming apparatus main body 12.

The shutter member 230Y is connected to the intermediate transfer belt unit 60 by the above-mentioned linkage mechanism 404. By the action of the linkage mechanism 404, the shutter member 230Y moves from the exposure position to the covering position in conjunction of an action making the intermediate transfer belt unit 60 open with respect to the image forming apparatus main body 12. By the action of the linkage mechanism 404, the shutter member 230Y moves from the covering position to the exposure position in conjunction with an action making the intermediate transfer belt unit 60 closed with respect to the image forming apparatus main body 12.

Figure 6:
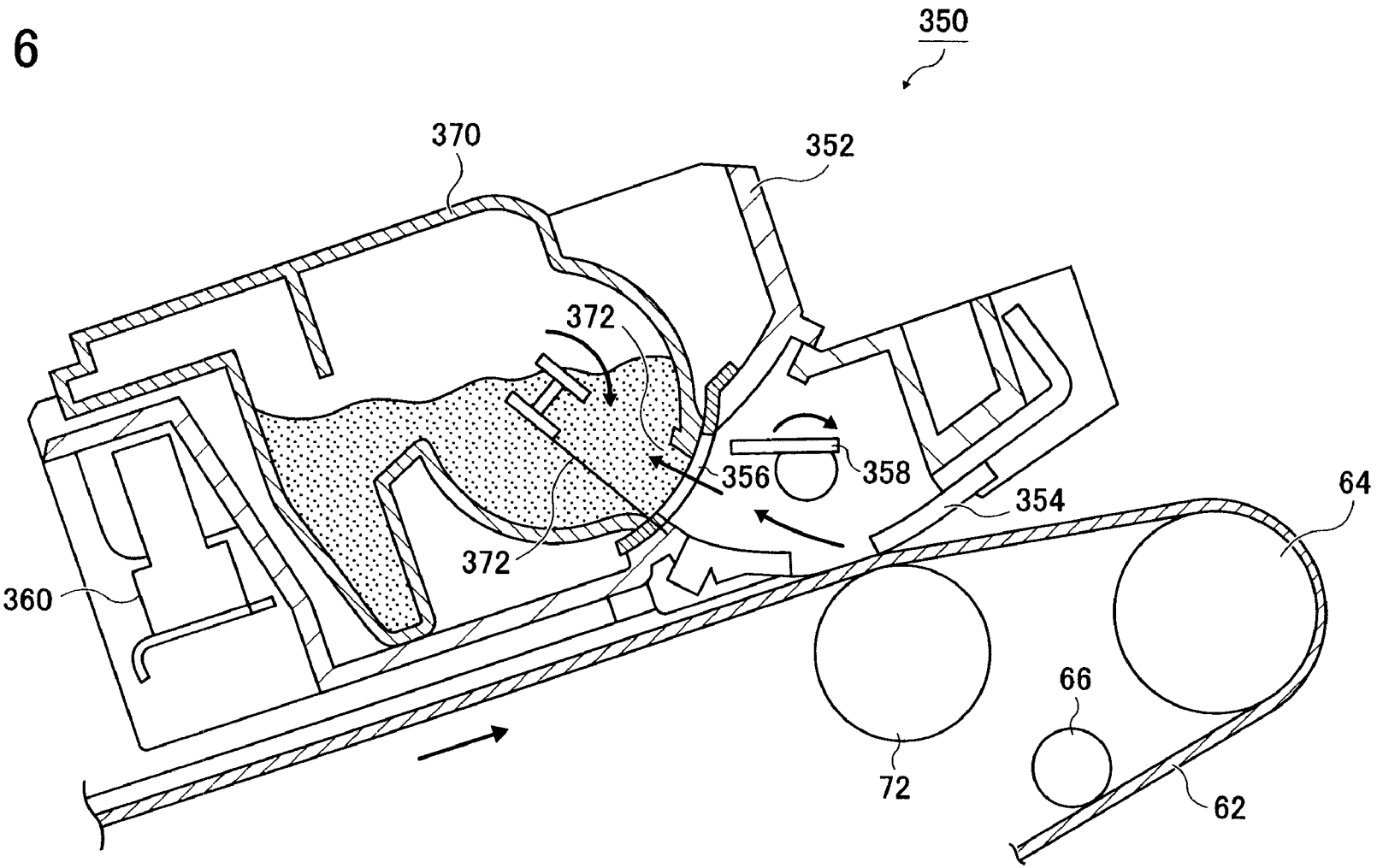
FIG. 6 is a cross-sectional view of a developer remover employed in the image forming apparatus shown in FIG. 1.

The developer remover 350 is shown in FIG. 6.

The developer remover 350 includes a developer remover main body 352 fixed to the main opening/closing part 26 (see FIG. 1) and a receiving container 370 which can be installed in and removed from the developer remover main body 352. The above-mentioned scraping member 354 is attached to the developer remover main body 352. A through hole 356 for developer particles to pass through is provided in the developer remover main body 352. An expelling member 358 is installed inside the developer remover main body 352.

The expelling member 358 rotates clockwise as indicated by an arrow in FIG. 6 to expel developer particles scraped off the surface of the intermediate transfer belt 62 by the scraping member 354 to the receiving container 370 through the through hole 356. Further, a fullness detecting sensor 360 which detects whether the receiving container 370 is full is installed in the developer remover main body 352.

Developer particles eliminated from the intermediate transfer belt 62 by the scraping member 354 and expelled by the expelling member 358 are accumulated in the receiving container 370. A through hole 372 for developer particles expelled by the expelling member 358 to pass through is provided in the receiving container 370 in a position corresponding to the through hole 356. Further, a developer expelling member 372 is installed inside the receiving container 370. The developer expelling member 372 expels developer particles toward the fullness detecting sensor 360 by rotating clockwise as indicated in FIG. 6.

The receiving container 370 is replaced when it becomes full. That is, when the receiving container 370 becomes full, the receiving container 370 should be removed from the developer remover main body 352 and taken out through an opening provided by opening the secondary opening/closing part 30 (see FIG. 2) and, in turn, another receiving container 370 should be installed in the developer remover main body 352.

There is a possibility that developer particles accumulated in the receiving container 370 melt due to heat generated by, for example, the fixing device 50 (see FIG. 1). If developer particles melt in the receiving container 370, subsequently hardened developer after melting may bring the developer expelling member 372 to standstill, not rotating. In turn, the standstill of the developer expelling member 372 makes it impossible to receive further developer particles, for example, even if there remains some space for receiving them in the receiving container 370.

Figure 7:
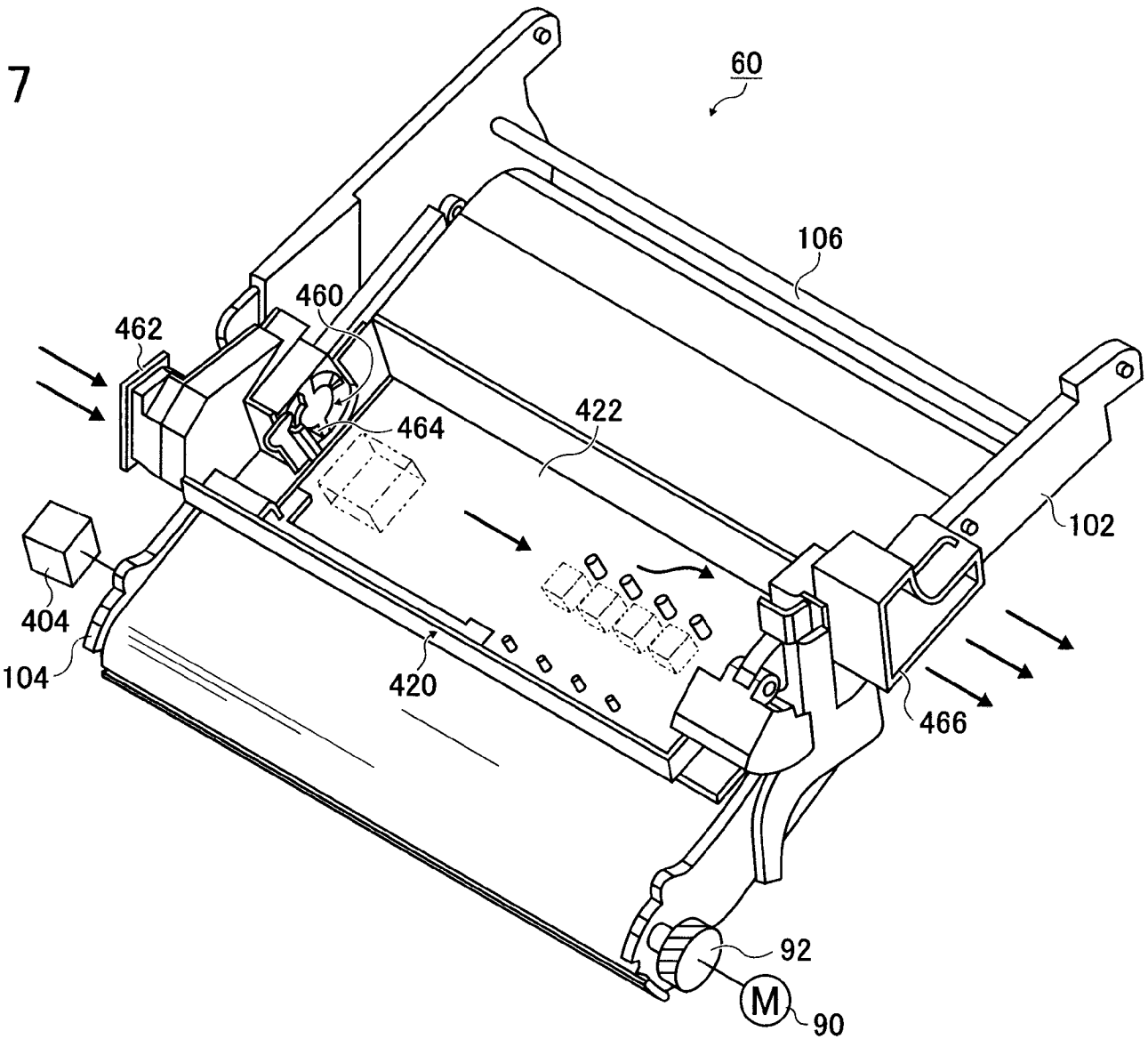
FIG. 7 is a perspective view of a belt unit employed in the image forming apparatus shown in FIG. 1.

The intermediate transfer belt unit 60 is shown in FIG. 7.

As can be seen in FIG. 7, the intermediate transfer belt unit 60 includes a right side plate 102, a left side plate 104, and a connecting member 106 which connects the right side plate 102 with the left side plate 104. The right side plate 102, the left side plate 104, and the connecting member 106 are used as an intermediate transfer body supporting part which supports the intermediate transfer belt 62. That is, the above-mentioned support rollers 64, 66, 68, 70, 72 (see FIG. 1) are installed, their ends being fastened to the right side plate 102 and the left side plate 104. The right side plate 102 and the left side plate 104 support the intermediate transfer belt 62 via the support rollers 64, 66, 68, 70, 72.

The right side plate 102 and the left side plate 104 also support the above-mentioned first transfer rollers 80Y, 80M, 80C, 80K (see FIG. 1).

The intermediate transfer belt unit 60 further includes a gear 92 placed on the shaft of the support roller 70 (see FIG. 1). The driving force from the motor 90 which is used as the driving source is conveyed to the gear 92, which in turn rotates the support roller 70, so that the driving force is conveyed to the intermediate transfer belt 62.

The intermediate transfer belt unit 60 is also connected to the above-mentioned linkage mechanism 404 (see FIG. 4). That is, the intermediate transfer belt unit 60 and each of the shutter members 230Y, 230M, 230C, 230K are connected via the linkage mechanism 404. As described above, thus, the shutter members 230Y, 230M, 230C, 230K are opened and closed in conjunction with opening and closing of the intermediate transfer belt unit 60 with respect to the image forming apparatus main body 12.

The second power supply unit 420 is installed, its short sides being fastened to the right side plate 102 and the left side plate 104. That is, both short sides of the power supply substrate 422 of the second power supply unit 420 are fastened to the right side plate 102 and the left side plate 104.

Furthermore, the intermediate transfer belt unit 60 includes an external air supply device 460.

The external air supply device 460 is used as a device supplying external air toward the second power supply unit 420 and includes an intake duct 462, a blast fan 464, and an exhaust duct 466. The intake duct 462 and the blast fan 464 are installed to the left side plate 104 and the exhaust duct 466 is installed to the right side plate 102. In the external air supply device 460, as the blast fan 464 revolves, external air is brought into the image forming apparatus main body 12

(see FIG. 1) through the intake duct 462 and let out of the image forming apparatus main body 12 through the exhaust duct 466.

Figure 8:
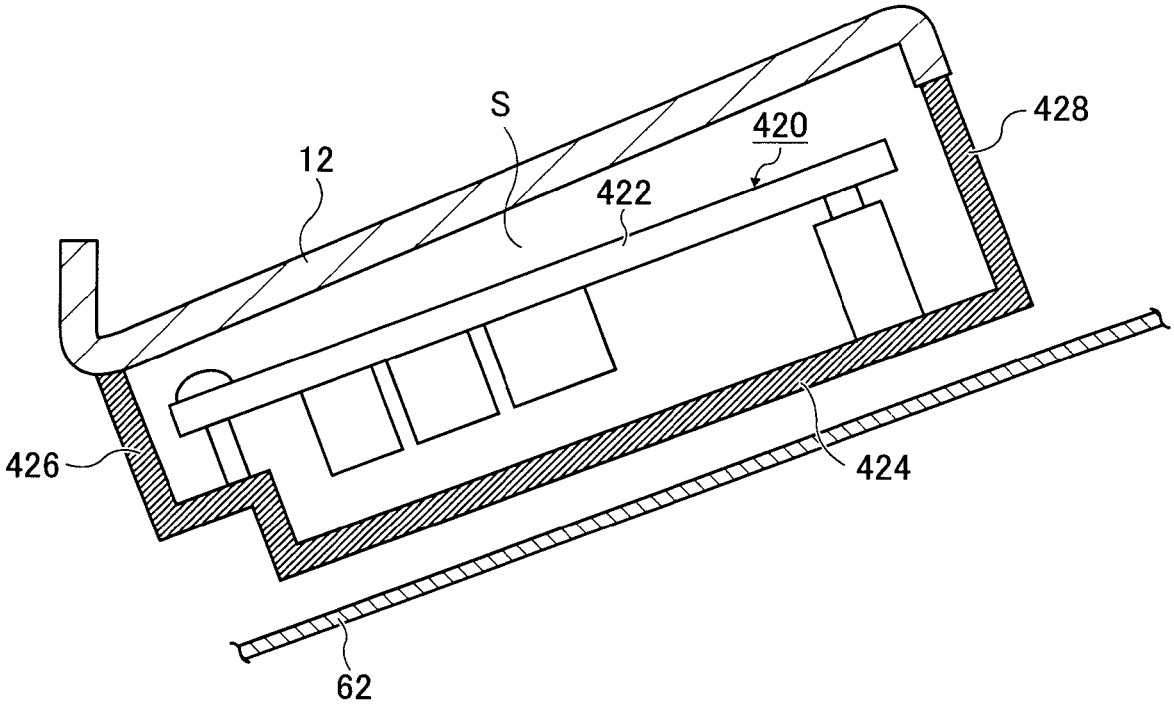
FIG. 8 is a cross-sectional view of a second power supply unit employed in the image forming apparatus shown in FIG. 1.

The second power supply unit 420 is shown in FIG. 8.

The second power supply unit 420 includes the power supply substrate 422, as already mentioned. The power supply unit 420 also has a bottom plate 424 beneath the power supply substrate 422, a front plate 426 positioned in the front, and a rear plate 428 in the rear. A space S surrounding the power supply substrate 422 is defined by the bottom plate 424, the front plate 426, the rear plate 428, and the image forming apparatus main body 12. The thus defined space S surrounding the power supply substrate 422 is intended to keep the user from coming in contact with the power supply substrate 422 and prevent electric shock and a similar accident.

Air enters the space S through the intake duct 462 (see FIG. 7) and the air inside the space S is let out through the exhaust duct 466 (see FIG. 7). Thus, an air flow takes place inside the space S from the back to the front in FIG. 8. In this way, the space S serves as a duct through which air flows.

The air flow inside the space S cools down the power supply substrate 422 and also cools down the intermediate transfer belt 62 moving beneath the space S. The air flow occurring in the space S impedes heat transfer from one end of the air flow to the other end. Consequently, this impedes the transfer of heat generated from the fixing device 50 (see FIG. 2) located before the second power supply unit 420 to the developer remover 350 located behind the second power supply unit 420. Accordingly, developer particles received in the developer remover 350 become hard to melt by heat.

Figure 9:
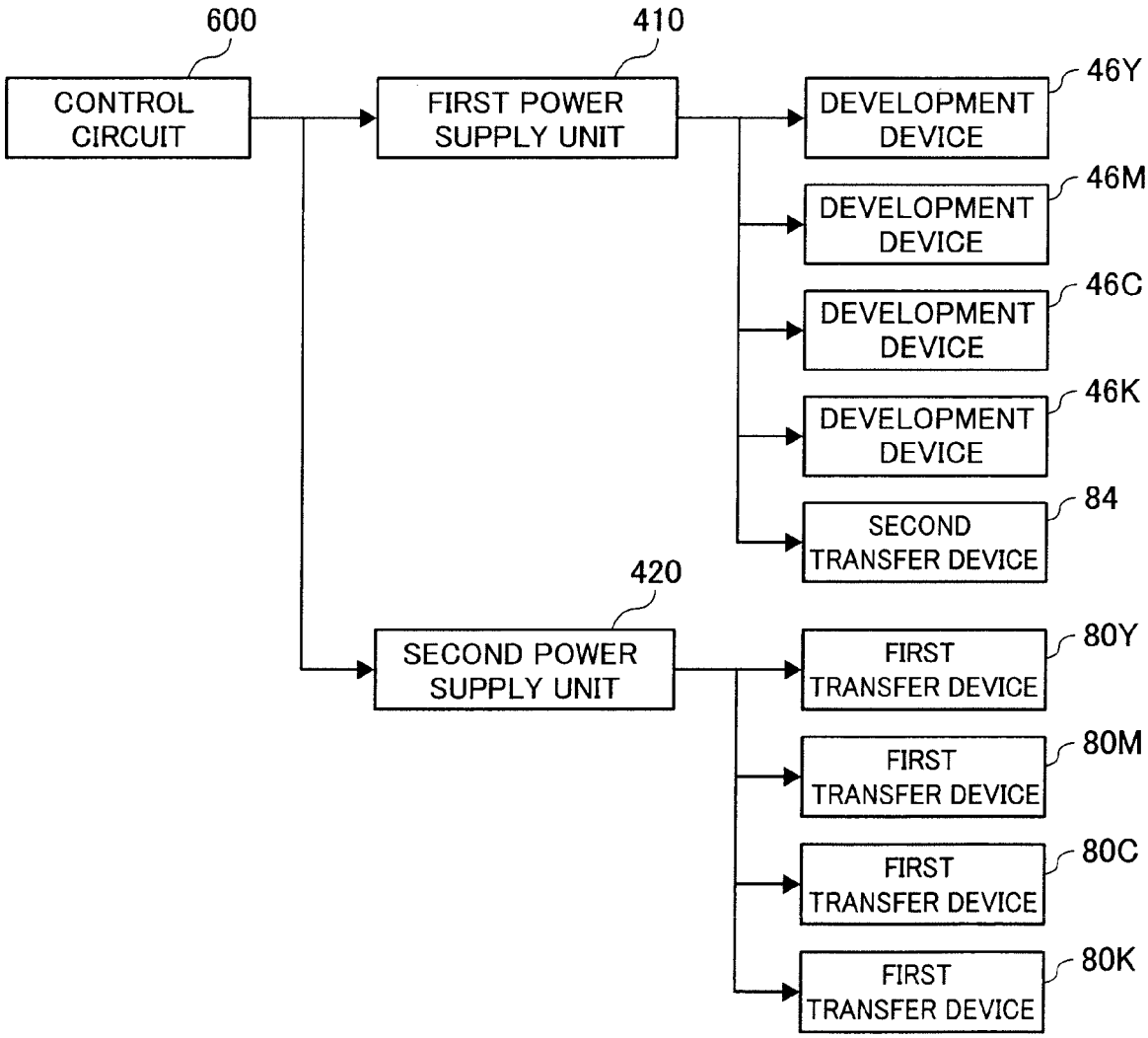
FIG. 9 is a block diagram illustrating power feeding in the image forming apparatus shown in FIG. 1.

FIG. 9 is a block diagram illustrating power feeding in the image forming apparatus 10.

As shown in FIG. 9, the image forming apparatus 10 includes a control circuit 600, and the first power supply unit 410 and the second power supply unit 420 are controlled by the control circuit 600.

The first power supply unit 410 supplies a high voltage to the development devices 46Y, 46M, 46C, 46K, and the second transfer device 84. In this way, the first power supply unit 410 installed in the image forming apparatus main body 12 feeds power to the development devices 46Y, 46M, 46C, 46K, and the second transfer device 84 which are also installed in the image forming apparatus main body 12.

The second power supply unit 420 supplies a high voltage to the first transfer devices 80Y, 80M, 80C, 80K. In this way, the second power supply unit 420 installed in the main opening/closing part 26 feeds power to the first transfer devices 80Y, 80M, 80C, 80K also installed in the main opening/closing part 26. This power feeding scheme avoids dense wiring for power feeding and shortens the wiring length, as compared with, for example, a case where power is distributed by wiring from the first power supply unit 410 to the first transfer devices 80Y, 80M, 80C, 80K, the wiring extending from the first power supply unit 410 in a vertical direction inside the image forming apparatus main body 12.

Next, an image forming apparatus 10 in accordance with a second exemplary embodiment of the invention is described. In the following description, descriptions of parts that are common to the image forming apparatus 10 in accordance with the above-described first exemplary embodiment are omitted and parts that differ from the above-described first exemplary embodiment are only described.

Figure 10:
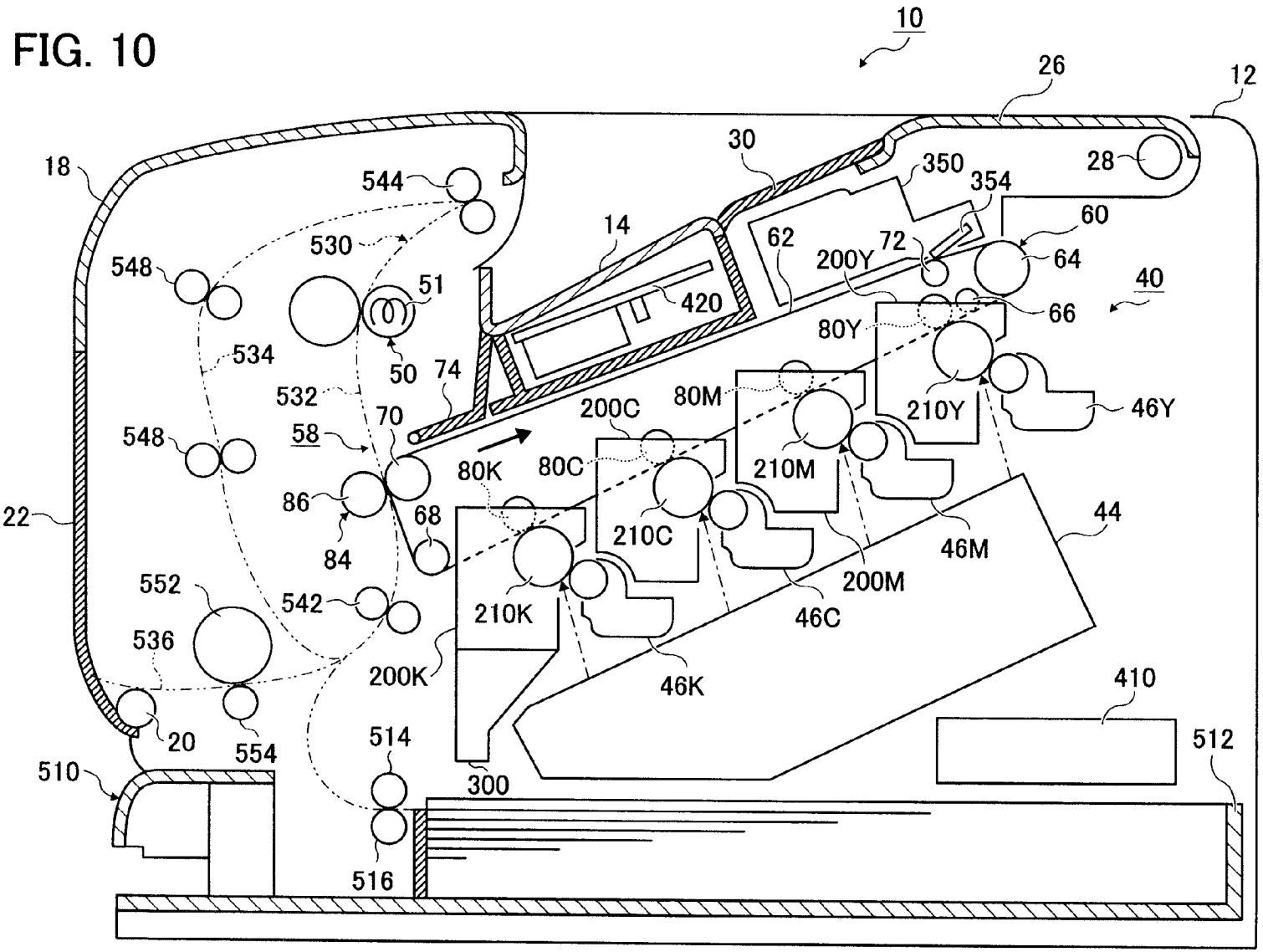
FIG. 10 is a perspective view showing an image forming apparatus in accordance with a second exemplary embodiment of the invention.

The image forming apparatus 10 in accordance with the second exemplary embodiment of the invention is shown in FIG. 10.

As shown in FIG. 10, the image forming apparatus 10 in accordance with the second exemplary embodiment includes a protection member 74 serving as a protection part that protects the intermediate transfer belt 62 as a part of the intermediate transfer belt unit 60, in addition to having all components included in the image forming apparatus 10 in accordance with the above-described first exemplary embodiment.

Figure 11:
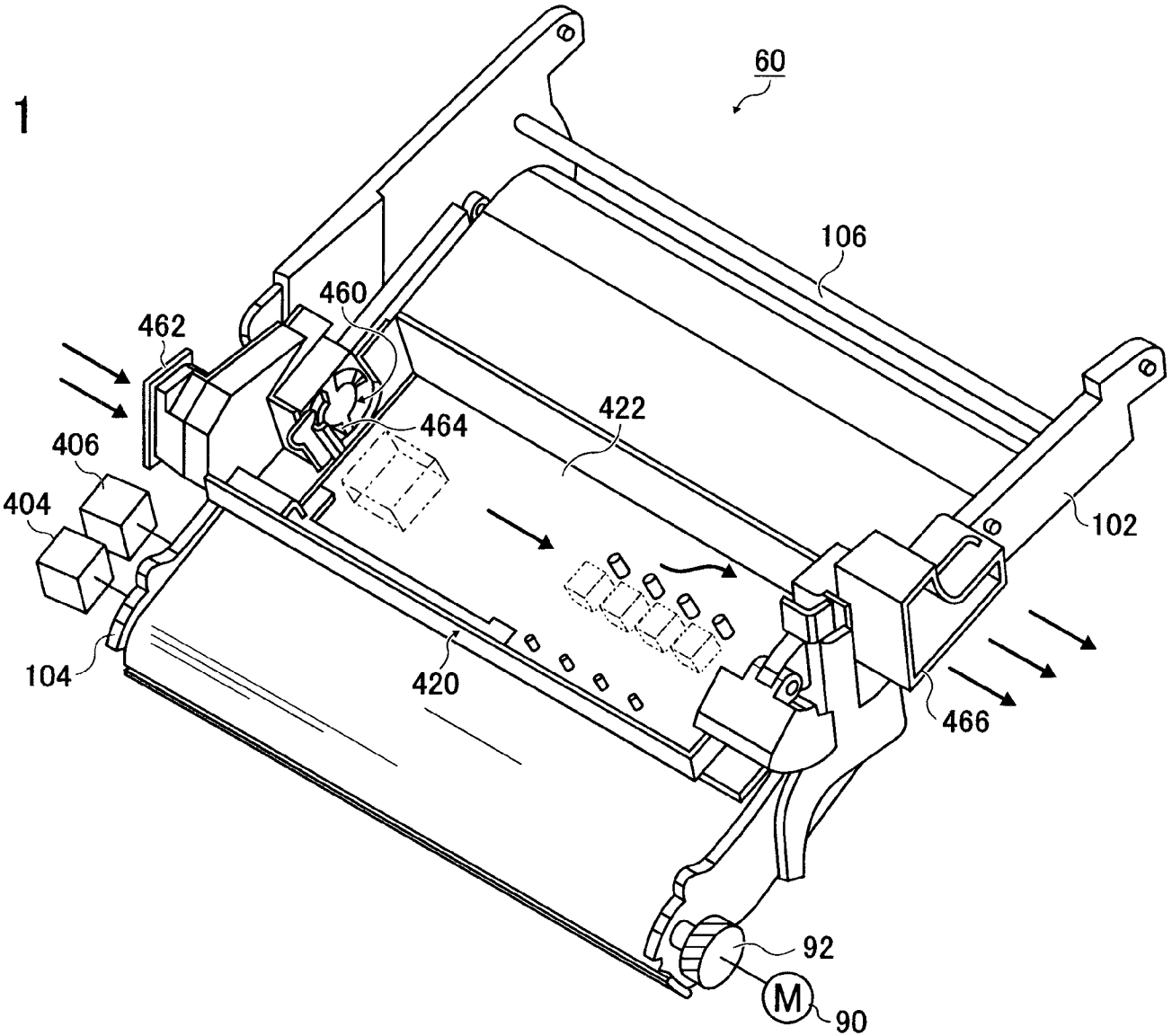
FIG. 11 is a perspective view of a belt unit employed in the image forming apparatus shown in FIG. 10.

The intermediate transfer belt unit 60 integrated in the main opening/closing part 26 of the image forming apparatus 10 in accordance with the second exemplary embodiment of the invention is shown in FIG. 11.

As shown in FIG. 11, in addition to having all components included in the image forming apparatus 10 in accordance with the above-described first exemplary embodiment, the image forming apparatus 10 in accordance with the second exemplary embodiment is configured such that a linkage mechanism 406 is connected to, for example, the left side plate 104 of the intermediate transfer belt unit 60. The above-mentioned protection member 74 (see FIG. 10) is connected to the linkage mechanism 406. That is, the intermediate transfer belt unit 60 and the protection member 74 are interconnected. The connection to the linkage mechanism 406 may be made via the main opening/closing part 26 united with the intermediate transfer belt unit 60.

Figure 12:
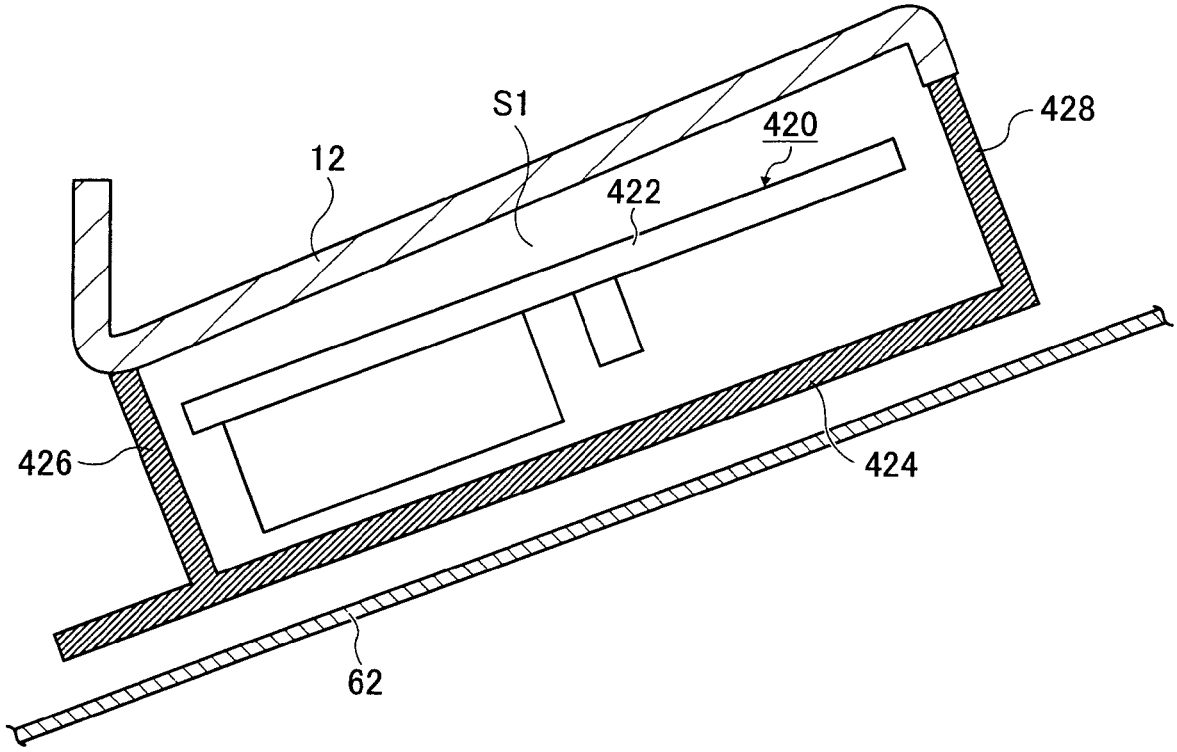
FIG. 12 is a cross-sectional view of a second power supply unit employed in the image forming apparatus shown in FIG. 10.

The second power supply unit 420 included in the image forming apparatus 10 in accordance with the second exemplary embodiment of the invention is shown in FIG. 12.

The second power supply unit 420 has the power supply substrate 422, as described above. The power supply unit 420 also has the bottom plate 424 beneath the power supply substrate 422, the front plate 426 positioned in the front, and the rear plate 428 positioned in the rear. A space S1 surrounding the power supply substrate 422 is defined by the bottom plate 424, the front plate 426, the rear plate 428, and the image forming apparatus main body 12. The thus defined space S1 surrounding the power supply substrate 422 is intended to keep the user from coming in contact with the power supply substrate 422 and prevent electric shock and a similar accident.

Air enters the space S1 through the intake duct 462 (see FIG. 7) and the air inside the space S1 is let out through the exhaust duct 466 (see FIG. 7). Thus, an air flow takes place inside the space S1 from the back to the front in FIG. 8. In this way, the space S1 serves as a duct through which air flows.

The air flow inside the space S1 cools down the power supply substrate 422 and also cools down the intermediate transfer belt 62 moving beneath the space S1. The air flow occurring in the space S1 produces a so-called air curtain and impedes heat transfer from one end to the other end with respect to a position where the air flow is formed in a direction intersecting with the air flow direction. Consequently, this impedes the transfer of heat generated from the fixing device 50 (see FIG. 2) located before the second power supply unit 420 to the developer remover 350 located behind the second power supply unit 420. Accordingly, developer particles received in the developer remover 350 become hard to melt by heat.

Figure 13:
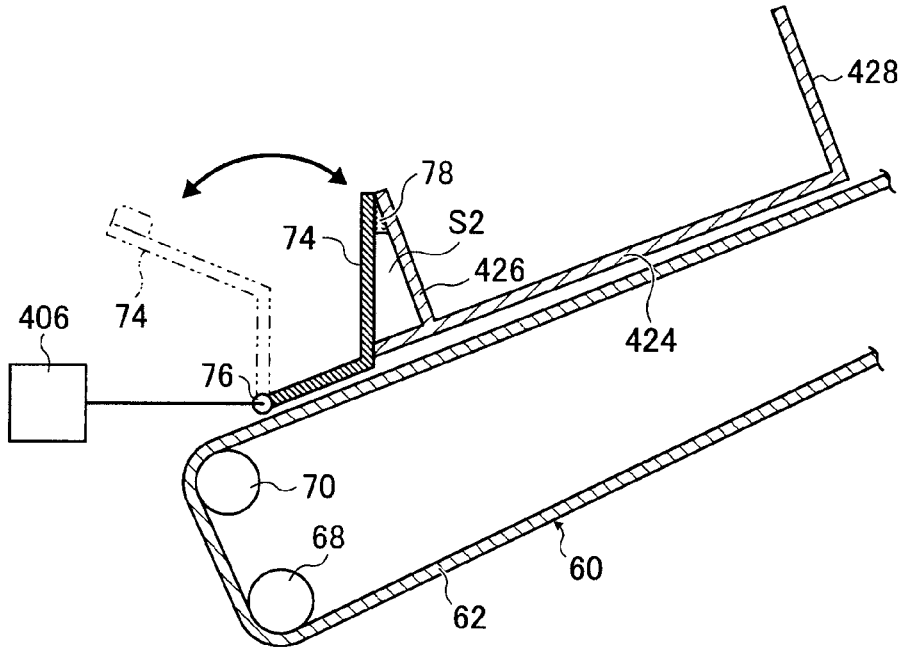
FIG. 13 is a first cross-sectional view of a protection member employed in the image forming apparatus shown in FIG. 10.
Figure 14:
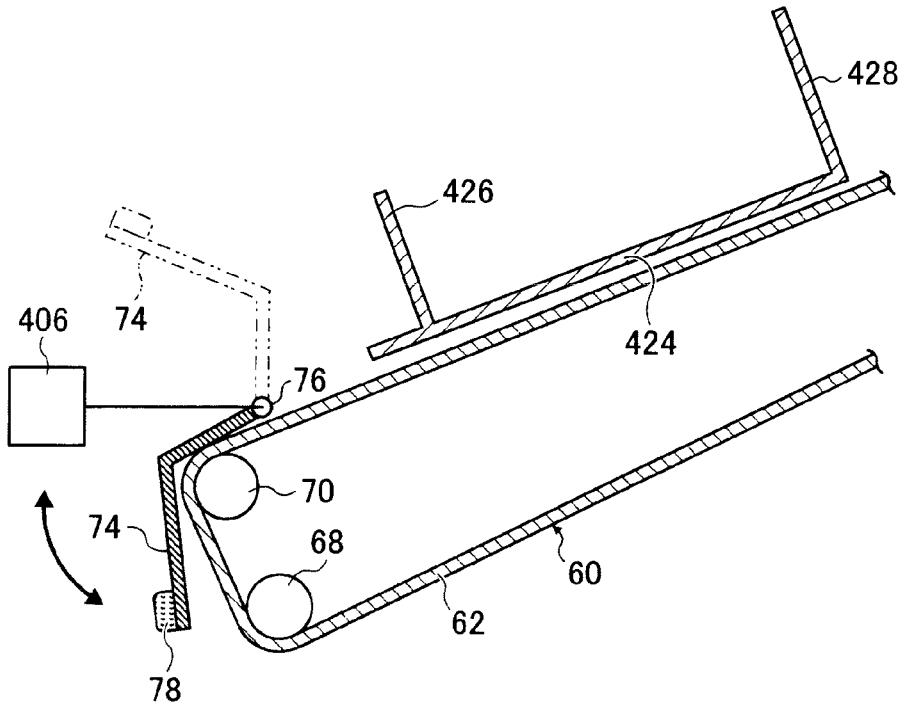
FIG. 14 is a second cross-sectional view of the protection member employed in the image forming apparatus shown in FIG. 10.

The protection member 74 included in the image forming apparatus 10 in accordance with the second exemplary embodiment of the invention is shown in FIG. 13 and FIG. 14.

The protection member 74 is hinged to, for example, the right side plate 102 and the left side plate 104 of the intermediate transfer belt unit 60 with hinges 76, so that it can turn and move between a second position shown in FIG. 13 and a first position shown in FIG. 14. Here, the protection member 74 may be hinged to the main opening/closing part 26 united with the intermediate transfer belt unit 60.

One end of the protection member 74 opposite to its end supported by the hinges 76 is fitted with a sealing member 78. For the sealing member 78, a material such as, e.g., sponge, which deforms by being pushed externally, is used.

The protection member 74 is connected to the linkage mechanism 406. Here, the linkage mechanism 406 is connected to, for example, the left side plate 104 of the intermediate transfer belt unit 60. Consequently, the protection member 74 moves in conjunction with opening and closing of the part including the intermediate transfer belt 62 with respect to the image forming apparatus main body 12. More specifically, the protection member 74 moves from the second position to the first position in conjunction with opening of the intermediate transfer belt 62 with respect to the image forming apparatus main body 12. The protection member 74 moves from the first position to the second position in conjunction with closing of the intermediate transfer belt 62 with respect to the image forming apparatus main body 12.

In a state where the protection member 74 is positioned in the first position as shown in FIG. 14, the protection member 74 covers a part of the intermediate transfer belt 62 to protect the intermediate transfer belt 62. In this exemplary embodiment, the protection member 74 covers the belt's front area that the user is likely to touch during work with hands reaching from the front of the apparatus, when the main opening/closing part 26 is open with respect to the image forming apparatus main body 12 (see FIG. 3). More specifically, the protection member 74 covers and protects the belt area between the support roller 68 and the support roller 70 for the intermediate transfer belt 62. Thereby, the protection member 74 can prevent an operator from directly touching the intermediate transfer belt 62, when the intermediate transfer belt unit 60 is open with respect to the image forming apparatus main body 12.

In a state where the protection member 74 is positioned in the second position as shown in FIG. 13, its end fitted with the sealing member 78 contacts the front plate 426 via the sealing member 78. As a result of the contact of the protection member 74 with the front plate 426, a space S2 is defined, surrounded by the protection member 74, the front plate 426, and the bottom plate 424.

The space S2 serves as an air passage. That is, air is supplied by the blast fan 464 (see FIG. 7) from the back in FIG. 13 and FIG. 14 and flows out of the front in FIG. 13 and FIG. 14. Instead of supplying air into the space S2 with the blast fan 464, for example, a fan other than the blast fan 464 may be used.

The air flow inside the space S2 cools down the intermediate transfer belt 62 moving beneath the space S2. The air flow occurring in the space S2 produces a so-called air curtain and impedes heat transfer from one end to the other end with respect to a position where the air flow is formed in a direction intersecting with the air flow direction. Consequently, this impedes the transfer of heat generated from the fixing device 50 (see FIG. 2) located before the space S2 to the developer remover 350 located behind the space S2. Accordingly, developer particles received in the developer remover 350 become hard to melt by heat.

As explained hereinbefore, the present invention can be applied to image forming apparatus such as, for example, copiers, printers, and facsimile equipment.

The present invention may be embodied in other specific forms without departing from its spirit or characteristics. The described exemplary embodiments are to be considered in all respects only as illustrated and not restrictive. The scope of the invention is, therefore, indicated by the appended claims rather than by the foregoing description. All changes that come within the meaning and range of equivalency of the claims are to be embraced within their scope.

What is claimed is:

1. An image forming apparatus comprising:

a plurality of image holders that hold an image respectively;

a plurality of development devices that produce an image on the plurality of image holders respectively;

an intermediate transfer body supported by a plurality of support members;

a plurality of first transfer devices that respectively transfer images which are respectively present on the plurality of image holders in turn and overlayingly onto the intermediate transfer body;

a second transfer device that transfers a composite transferred image from the intermediate transfer body onto a recording medium;

a fixing device that fixes the composite image onto the recording medium by applying heat and pressure to the recording medium having the composite image transferred thereto;

an ejection device that ejects the recording medium having the composite image fixed thereto out of the image forming apparatus main body; and a recording medium stacking part where ejected recording media are stacked, the plurality of image holders being arranged along an under side of the intermediate transfer body, the apparatus further comprising:

a first power supply unit located beneath the plurality of image holders;

a second power supply unit located above the intermediate transfer body; and an external air supply device that supplies external air toward the second power supply unit.

2. The image forming apparatus according to claim 1, wherein the first power supply unit feeds power to at least the plurality of development devices respectively, and the second power supply unit feeds power to at least the plurality of first transfer devices respectively.

3. The image forming apparatus according to claim 1, further comprising a latent image producing device that is located beneath the plurality of image holders and produces a latent image on the plurality of image holders respectively, wherein the first power supply unit is located beneath the latent image producing device.

4. The image forming apparatus according to claim 1, wherein the second power supply unit is located between the intermediate transfer body and the recording medium stacking part.

5. The image forming apparatus according to claim 1, further comprising a developer remover that removes developer particles from the intermediate transfer body, wherein the developer remover and the fixing device are located near outside opposite long lateral walls of the second power supply unit.

6. The image forming apparatus according to claim 1, further comprising an opening/closing part that is opened and closed with respect to the image forming apparatus main body, wherein the recording medium stacking part is defined on the opening/closing part and the opening/closing part incorporates at least the second power supply unit and the intermediate transfer body.

7. The image forming apparatus according to claim 1, wherein the intermediate transfer body is disposed aslant such that one end portion of the intermediate transfer body adjoining the second transfer device is positioned lower than an opposite end portion of the intermediate transfer body.

8. An image forming apparatus comprising:

an image holder that holds an image;

an intermediate transfer body onto which a developer image is transferred from the image holder, the intermediate transfer body being located over the image holder;

a first power supply unit located beneath the image holder;

a second power supply unit located above the intermediate transfer body; and an external air supply device that supplies external air toward the second power supply unit.

9. The image forming apparatus according to claim 8, further comprising a developer remover that removes developer particles from the intermediate transfer body.

10. An image forming apparatus comprising:

a conveying member that conveys an image or a recording medium bearing an image; and a protection part that protects the conveying member, the protection part moving between a first position where the protection part covers at least a part of the conveying member and a second position where an air passage is defined.

11. The image forming apparatus according to claim 10, wherein the conveying member is installed to be openable and closable with respect to the image forming apparatus main body, and the protection part moves from the second position to the first position in conjunction of an action making the conveying member open with respect to the image forming apparatus main body and the protection part moves from the first position to the second position in conjunction of an action making the conveying member closed with respect to the image forming apparatus main body.

12. The image forming apparatus according to claim 10, further comprising a sealing member that seals the air passage in a state where the protection part is positioned in the second position.

13. The image forming apparatus according to claim 10, further comprising:

a container that receives developer particles; and a fixing device that fixes an image onto paper using at least heat, wherein the container and the fixing device are located near outside opposite long lateral walls of the air passage.

14. An image forming apparatus comprising:

an image forming apparatus main body;

a conveying member that conveys an image or a recording medium bearing an image, the conveying member being openable and closable with respect to the image forming apparatus main body;

an air passage defining part where an air passage is defined, the air passage defining part being united with the conveying member and openable and closable with respect to the image forming apparatus main body;

a container that receives developer particles; and a fixing device that fixes an image onto paper using at least heat, the container and the fixing device being located near outside opposite long lateral walls of the air passage.

15. The image forming apparatus according to claim 14, wherein the air passage defining part includes, as at least a part of thereof, a protection part that protects the conveying member.

16. The image forming apparatus according to claim 14, wherein the air passage defining part includes, as at least a part of thereof, an enclosure part that encloses a power supply substrate.

17. An image forming apparatus comprising:

a plurality of image holders that hold an image respectively;

a plurality of development devices that produce an image on the plurality of image holders respectively;

an intermediate transfer body supported by a plurality of support members;

a protection part that protects the intermediate transfer body;

a plurality of first transfer devices that respectively transfer images which are respectively present on the plurality of image holders in turn and overlayingly onto the intermediate transfer body;

a second transfer device that transfers a composite transferred image from the intermediate transfer body onto a recording medium;

a fixing device that fixes the composite image onto the recording medium by applying heat and pressure to the recording medium having the composite image transferred thereto;

an ejection device that ejects the recording medium having the composite image fixed thereto out of the image forming apparatus main body; and a recording medium stacking part where ejected recording media are stacked, the plurality of image holders being arranged along an under side of the intermediate transfer body, the apparatus further comprising:

a first power supply unit located beneath the plurality of image holders; and a second power supply unit located above the intermediate transfer body, the protection part moving between a first position where the protection part covers at least a part of the intermediate transfer body and a second position where an air passage is defined.

18. An image forming apparatus comprising:

an image forming apparatus main body;

a plurality of image holders that hold an image respectively, provided in the image forming apparatus main body;

a plurality of development devices that produce an image on the plurality of image holders respectively;

a container that receives developer particles;

an intermediate transfer body supported by a plurality of support members, the intermediate transfer body being openable and closable with respect to the image forming apparatus main body;

an air passage defining part where an air passage is defined, the air passage defining part being united with the intermediate transfer body and openable and closable with respect to the image forming apparatus main body;

a plurality of first transfer devices that respectively transfer images which are respectively present on the plurality of image holders in turn and overlayingly onto the intermediate transfer body;

a second transfer device that transfers a composite transferred image from the intermediate transfer body onto a recording medium;

a fixing device that fixes the composite image onto the recording medium by applying heat and pressure to the recording medium having the composite image transferred thereto;

an ejection device that ejects the recording medium having the composite image fixed thereto out of the image forming apparatus main body; and a recording medium stacking part where ejected recording media are stacked, the plurality of image holders being arranged along an under side of the intermediate transfer body, the apparatus further comprising:

a first power supply unit located beneath the plurality of image holders; and a second power supply unit located above the intermediate transfer body, the container and the fixing device being located near outside opposite long lateral walls of the air passage.

19. An image forming apparatus comprising:

an image holder that holds an image;

an intermediate transfer body onto which a developer image is transferred from the image holder, the intermediate transfer body being located over the image holder;

a protection part that protects the intermediate transfer body;

a first power supply unit located beneath the image holder; and a second power supply unit located above the intermediate transfer body, the protection part moving between a first position where the protection part covers at least a part of the intermediate transfer body and a second position where an air passage is defined.

20. An image forming apparatus comprising:

an image forming apparatus main body;

an image holder that holds an image, provided in the image forming apparatus main body;

a container that receives developer particles;

a fixing device that fixes an image onto paper using at least heat;

an intermediate transfer body onto which a developer image is transferred from the image holder, the intermediate transfer body being openable and closable with respect to the image forming apparatus main body and located over the image holder;

an air passage defining part where an air passage is defined, the air passage defining part being united with the intermediate transfer body and openable and closable with respect to the image forming apparatus main body;

a first power supply unit located beneath the image holder; and a second power supply unit located above the intermediate transfer body, the container and the fixing device being located near outside opposite long lateral walls of the air passage.

* * * * *